United States Patent [19]

Brown

[11] Patent Number: 4,641,435

[45] Date of Patent: Feb. 10, 1987

[54] COMBINATION SQUARE

[76] Inventor: Victor K. Brown, 1518 79th Ave. SE, Everett, Wash. 98205

[21] Appl. No.: 793,524

[22] Filed: Oct. 31, 1985

[51] Int. Cl.[4] ..... B43L 7/00

[52] U.S. Cl. ..... 33/427; 33/464; 33/474

[58] Field of Search ..... 33/427, 416, 417, 419, 33/428, 429, 464, 467, 470, 474, 479, 480, 463, 421, 425–476

[56] References Cited

U.S. PATENT DOCUMENTS

| | | | |
|---|---|---|---|
| 485,456 | 11/1892 | Cook | 33/470 |
| 778,808 | 12/1904 | Starrett | 33/464 |
| 1,060,388 | 4/1913 | Wall | 33/464 |
| 1,325,097 | 12/1919 | Lalor | 33/470 |
| 1,532,353 | 4/1925 | Waldron | 33/464 |
| 1,610,803 | 12/1926 | McReynolds | 33/470 |
| 1,644,624 | 10/1927 | Andersen | 33/464 |
| 2,448,440 | 8/1948 | King | 33/464 |
| 2,654,954 | 10/1953 | Lawrence | 33/464 |
| 3,293,752 | 12/1966 | Shuman | 33/470 |
| 3,296,702 | 1/1967 | Feddish | 33/464 |
| 3,456,353 | 7/1969 | Iaus | 33/474 |
| 3,484,945 | 12/1969 | Clark | 33/464 |
| 3,488,868 | 1/1970 | Gutowski et al. | 33/464 |

FOREIGN PATENT DOCUMENTS

| | | | |
|---|---|---|---|
| 246550 | 5/1912 | Fed. Rep. of Germany | 33/475 |

*Primary Examiner*—Willis Little

*Attorney, Agent, or Firm*—Ward Brown; Robert W. Beach

[57] ABSTRACT

A straight edge stock is lockable at any desired location along the length of a steel rule with the stock and rule forming perpendicular straight edges. The stock includes an integral protractor triangle projecting from a thicker barrel of the stock and having a hypotenuse edge extending generally from the bottom of the stock barrel angularly toward the rule. The margin of the protractor triangle adjacent to its hypotenuse edge has a scale of angle calibration markings indicating the angle of a line connecting each individual marking and the top of the leading edge of the thicker stock barrel.

6 Claims, 7 Drawing Figures

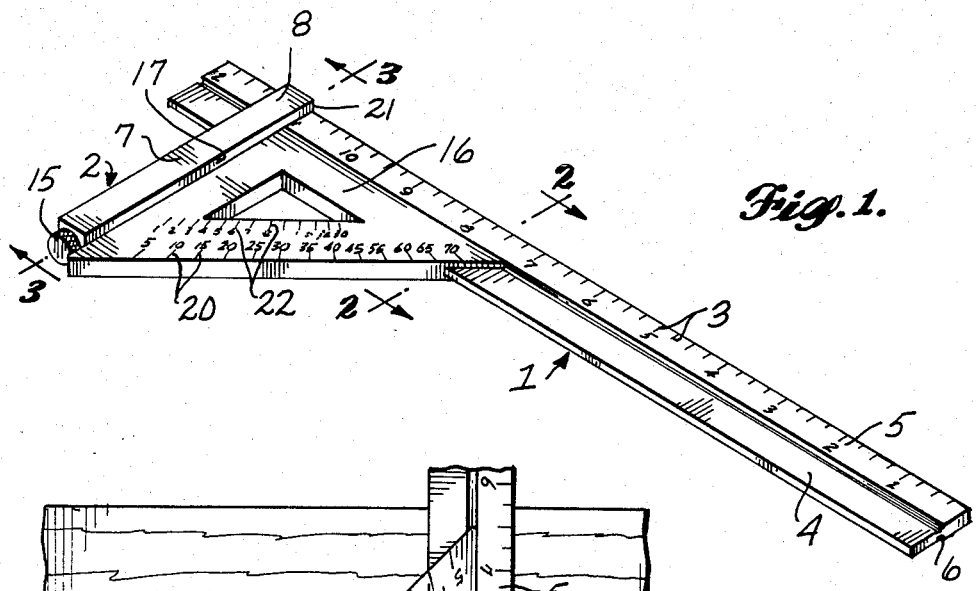
Fig. 1.
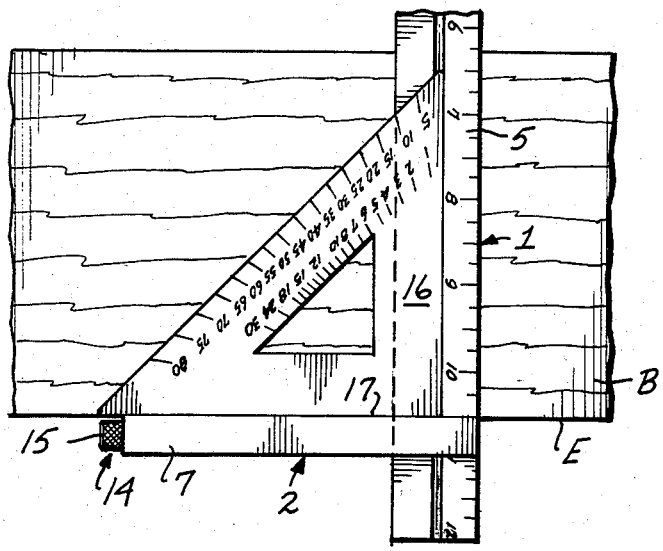
Fig. 4.
Fig. 3.
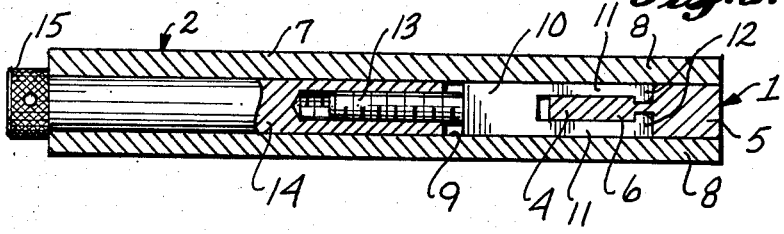
Fig. 2.
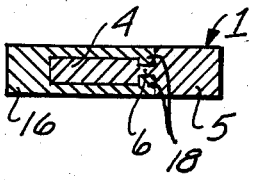

COMBINATION SQUARE

BACKGROUND OF THE INVENTION

1. Field of the Invention

The present invention relates to a tool usable by carpenters for marking or scribing lines on boards or other flat construction materials, such tool being of the general type having perpendicular straight edges one of which is slidable along the other.

2. Prior Art

Various attempts have been made to improve on the standard framing square or try square used by carpenters in marking or scribing boards and measuring and checking cuts, one of the more successful being the general type of combination square shown in King U.S. Pat. No. 2,448,440, issued Aug. 31, 1948, which has a steel rule and a separate head or stock lockable at any desired location along the length of the rule.

Starrett U.S. Pat. No. 778,808, issued Dec. 27, 1904, discloses a similar combination or bevel square in which the rule can be pivoted relative to the stock and locked in position for making angle markings or checking bevel cuts.

Other devices specifically adapted for making angle markings are shown in Cook U.S. Pat. No. 485,456, issued Nov. 1, 1892, Lafferty U.S. Pat. No. 611,129, issued Sept. 20, 1898, McReynolds U.S. Pat. No. 1,610,803, issued Dec. 14, 1926, Andersen U.S. Pat. No. 1,644,624, issued Oct. 4, 1927, Lawrence U.S. Pat. No. 2,654,954, issued Oct. 13, 1953, and Lalor U.S. Pat. No. 1,325,097, issued Dec. 16, 1919.

A more complicated device for making angle markings including miters is disclosed in Waldron U.S. Pat. No. 1,532,353, issued Apr. 7, 1925.

Attachments for framing squares are shown in Wall U.S. Pat. No. 1,060,388, issued Apr. 29, 1913, and Feddish U.S. Pat. No. 3,296,702, issued Jan. 10, 1967.

SUMMARY OF THE INVENTION

It is an object of the present invention to provide an improved tool usable for marking or scribing boards or for measuring or checking cuts.

In accordance with the above object, it is an object to provide such a tool usable in making markings perpendicular to the edge of a board or at any desired angle.

It also is an object to provide such a tool usable for quickly and conveniently marking roof framing components, such as rafters, for bevel cuts.

An additional object is to provide such a tool of simple uncomplicated construction, inexpensive to manufacture and easy to use, preferably resembling known standard tools both in construction and use.

In the preferred embodiment of the present invention, the foregoing objects are accomplished by providing a combination square having a steel rule straight edge, a straight edge stock slidable along the length of the rule while remaining perpendicular thereto, and mechanism for locking the stock at any desired position on the rule, such stock incorporating a pivot point engageable against a board edge about which the square is swung and a protractor scale immediately indicating the angle of the rule straight edge relative to the board edge.

BRIEF DESCRIPTION OF THE DRAWINGS

FIG. 1 is a top perspective of a combination square in accordance with the present invention; FIG. 2 is a section along line 2—2 of FIG. 1; and FIG. 3 is a section along line 3—3 of FIG. 1.

FIG. 4 is a fragmentary top plan of the square of FIG. 1 illustrating use of the square in making a marking perpendicular to the edge of a board.

DETAILED DESCRIPTION

Figure 5:
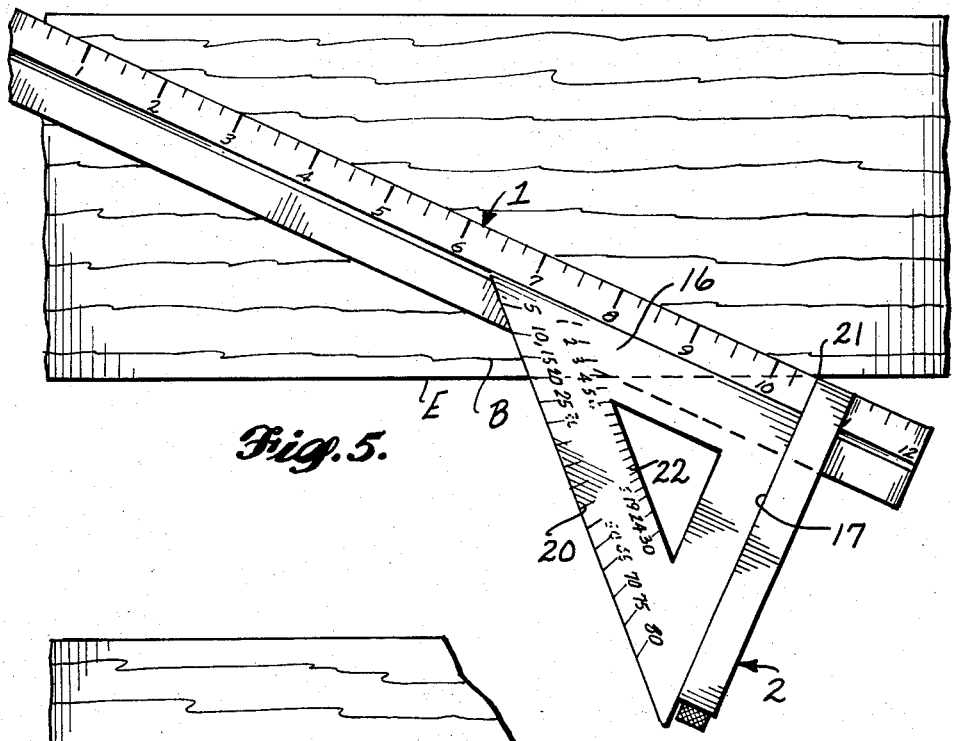
FIG. 5 is a fragmentary top plan of the square of FIG. 1 illustrating use of the square in making a marking at an acute angle relative to the edge of a board.

The preferred form of a combination square in accordance with the present invention shown in FIGS. 1, 2 and 3 has long and short, perpendicular straight edges. The longer straight edge is a steel rule 1 with the usual scale of calibration markings 3 along the top margin of its opposite faces. As seen in FIG. 2, such rule is of generally T cross section, the lower thinner portion 4 shown toward the left of FIG. 2 being joined to the upper thicker portion 5 by an even thinner central neck 6 forming longitudinally extending, rectangular grooves in both faces of the rule at the base of the upper thicker portion 5.

The shorter straight edge or stock 2 has a thick trailing or barrel portion 7 of rectangular cross section with upward-projecting arms 8 between which the rule 1 is fitted. Preferably the upper ends of such arms 8 are precisely registered with the top of the rule as best seen in FIG. 3.

As also seen in FIG. 3, the stock barrel 7 has a central bore 9 of a diameter approximately equal to the thickness of the upper rule portion 5 and receiving mechanism for locking the stock in position extending perpendicular to the rule 1 at any desired location along the length of the rule. Such locking mechanism includes an upper slide 10 with upwardprojecting fingers 11 embracing the opposite sides of the thinner rule bottom portion 4 and ending in inward-projecting dogs 12 snugly but slidably fitted in the central, longitudinally extending grooves in the opposite faces of the rule. The outer edges of the slide are coplanar with the opposite faces of the thicker rule portion 5. A threaded spindle 13 projects downward from the slide 10 into the central, complimentally threaded bore of a long locknut 14 having an enlarged knurled head 15 at the bottom of the stock barrel 7.

As seen in FIG. 1, the stock 2 includes a flat protractor triangle 16 integral with the barrel 7 and projecting from its leading straight edge 17. The upper leg of the triangle extends parallel to the rule 1 and butts against the thicker upper portion 5 of the rule. A longitudinally extending groove formed in the upper margin of such triangle upper leg receives the thinner rule portion 4 with inward-projecting dogs 18 snugly but slidably fitted in the longitudinally extending rule grooves, as seen in FIG. 2. Such dogs 18 can be formed at only the leading tip portion of the triangle 16 but, preferably, extend the full length of its upper leg.

The hypotenuse margins of the opposite faces of the stock triangle 16 have corresponding scales of angle calibration markings 20. In the embodiment shown, such markings indicate the angle, relative to the rule, of a line intersecting the top tip or pivot point 21 of the straight leading edge 17 of the stock barrel 7 and the marking of scale 20. An additional scale 22 can be provided indicating the equivalent pitch of a roof component, such as a rafter, cut at the corresponding angle. For example, the marking of scale 20 labeled "45" indicates an angle of 45 degrees for the line intersecting such marking and the pivot point 21 relative to the upper edge of the rule 1 and is registered with the marking labeled "12" of the additional scale 22 indicating that a rafter cut at such angle will result in a roof having a rise of 12 units for each 12-unit run.

FIG. 4 illustrates use of the combination square in accordance with the present invention for marking or scribing a line perpendicular to an edge E of an elongated board B. First, the stock 2 is locked at a desired location along the length of rule 1 by tightening the locknut 14 which draws the rule downward slightly to clamp it against the upper leg of the stock triangle 16. The leading edge 17 of the stock barrel 7 is held against the board edge E. Since the stock triangle 16 is of the same thickness as the thicker portion 5 of the rule and has its opposite faces coplanar with the opposite faces of such rule portion 5, there is no tendency of the stock or rule to twist or tilt relative to the board. The desired line can be marked or scribed along the top edge of the rule.

As shown in FIG. 5, for marking or scribing a line at a desired angle relative to the edge E of the board B, the square can be rotated about its pivot point 21 until the desired marking of the scale 20 or 22 is registered with the board edge, indicating that the top of the rule is at the desired angle.

Figure 6:
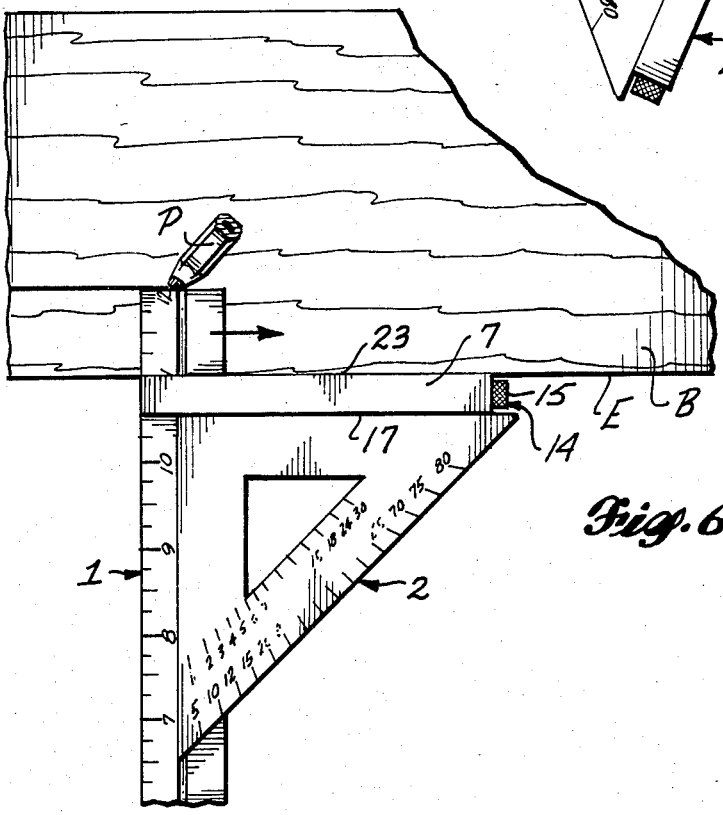
FIG. 6 is a fragmentary top plan of the square of FIG. 1 illustrating use of the square in making a marking parallel to the edge of a board.

As shown in FIG. 6, the combination square in accordance with the present invention still can be used for marking or scribing a line parallel to the edge E of the board by butting the trailing edge 23 of the stock barrel 7 against such board edge and sliding it lengthwise while holding a pencil P or other marking or scribing instrument against the end of the inward-projecting rule, which is first positioned at the desired distance from the board edge and locked relative to the stock. In the same orientation, the locknut 15 can be loosened, allowing the rule 1 to be slid lengthwise in and out for use of the square as a depth gauge.

Figure 7:
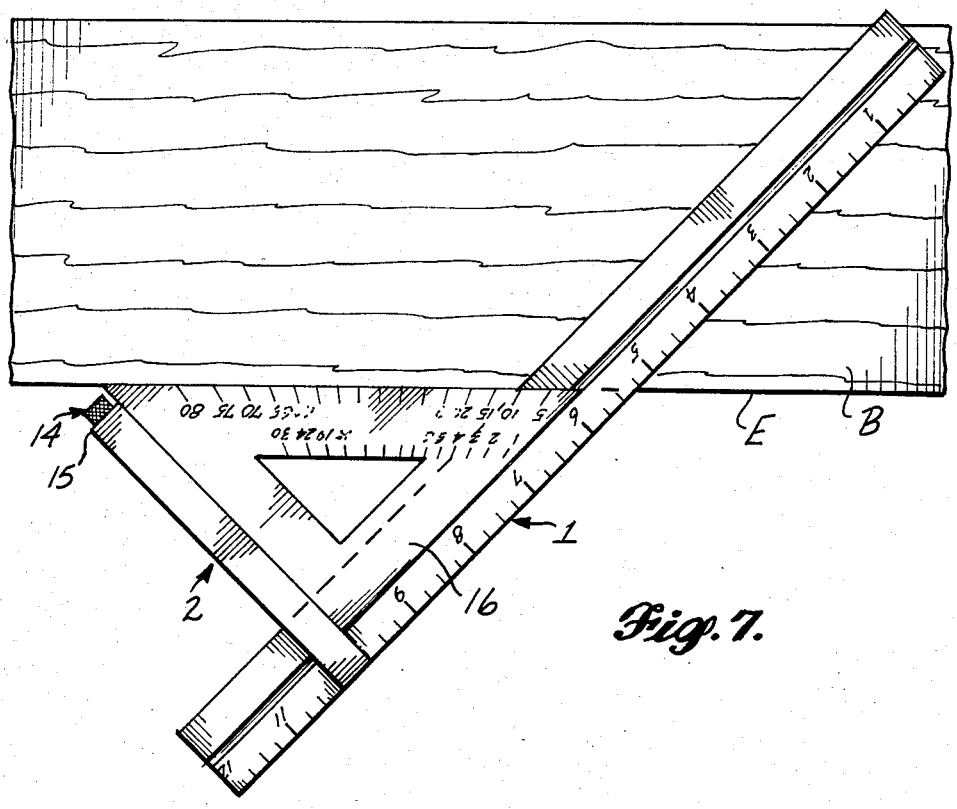
FIG. 7 is a fragmentary top plan of the square of FIG. 1 illustrating use of the square in making a marking at an angle of 45 degrees to the edge of a board.

FIG. 7 illustrates an alternative orientation of the square for marking or scribing a line at an angle of 45 degrees relative to the edge E of board B. The hypotenuse edge of the stock triangle 16 preferably extends at an angle of 45 degrees relative to the top of the rule 1. In addition, preferably the trailing edge of such triangle extends downward beyond the projecting end of the locknut 15. Consequently, as seen in FIG. 7, the square can be tilted relative to the board B so that such hypotenuse edge can be engaged contiguously against the board edge E and a line extending at an angle of 45 degrees relative to the board edge can be marked or scribed along the bottom edge of the rule which is engaged against the upper face of the board.

I claim:

1. In a combination square for marking a line on the face of a board having a linear edge, such square including an elongated rule having a straight longitudinal edge and a planar longitudinal marginal portion adjacent to such edge, a stock thicker than the rule and having a straight edge, and means for locking the stock at any location along the length of the rule with the stock extending perpendicular to the rule, the improvement comprising the stock including a pivot point engageable against the board edge for rotation of the stock and rule relative to the board edge about said pivot point with said planar longitudinal marginal portion of the rule contiguously engaged against the board face, the stock further including a protractor portion having a flat face coplanar with the planar longitudinal marginal portion of the rule for contiguously engaging and steadying the stock as it is rotated and a scale of angle calibration markings indicating the angle of the rule relative to the board edge when said pivot point is engaged against the board edge with the rule longitudinal marginal portion contiguously engaged against the face of the board.

2. In the square defined in claim 1, the improvement further comprising the rule being of generally T cross section including an upper thicker portion having the planar longitudinal marginal portion adjacent to the straight longitudinal edge and a lower portion thinner than the upper portion, the protractor portion projecting from the thicker straight edge of the stock and having a central groove receiving the rule lower portion.

3. In the square defined in claim 2, the thickness of the protractor portion being approximately the same as the upper portion of the rule, and the protractor portion having opposite flat faces substantially coplanar with the opposite faces of the upper portion of the rule.

4. In the square defined in claim 2, the protractor portion including a first edge extending generally parallel to the length of the rule, a second edge extending generally parallel to the length of the stock and intersecting said first edge and a third edge connecting the ends of said first and second edges remote from their point of intersection, said third edge having the scale of angle calibration markings.

5. In the square defined in claim 1, the stock including upward-projecting arms embracing the upper portion of the rule, the top ends of said arms being registered with the top edge of the rule, and the stock having a leading edge extending along the length of said arms, the upper end of said leading edge forming the pivot point at a location registered with the top of the rule.

6. In a combination square for marking a line on the face of a board having a linear edge, such square including an elongated rule having a straight longitudinal edge and opposite faces with planar marginal portions adjacent to such edge, a stock having a straight edge portion thicker than the rule, and means for locking the stock at any location along the length of the rule with the stock straight edge portion extending perpendicular to the rule, the improvement comprising the stock straight edge portion including a pivot point engageable against the board edge with either of the marginal portions of the rule flat against the board face for rotation of the stock and rule relative to the board edge about said pivot point, the stock further including a protractor portion having flat opposite side faces coplanar with the rule planar marginal portions and a scale of angle calibration markings indicating the angle of the rule straight edge relative to the board edge when said pivot point is engaged against the board edge with either of the rule marginal portions engaged against the face of the board.

* * * * *